US005944188A

United States Patent [19]

Grosskopf et al.

[11] Patent Number: 5,944,188

[45] Date of Patent: Aug. 31, 1999

[54] SAMPLE PACKAGE

[75] Inventors: Glenn A. Grosskopf, Lake Zurich, Ill.; Carl W. Treleaven, Greensboro, N.C.; James A. Hennessey, Chicago, Ill.

[73] Assignees: Pharmagraphics (Midwest), L.L.C.; Pharmagraphics (Southeast), L.L.C., both of Greensboro, N.C.

[21] Appl. No.: 09/198,174

[22] Filed: Nov. 23, 1998

Related U.S. Application Data

[62] Division of application No. 08/979,232, Nov. 21, 1997, Pat. No. 5,842,324, which is a division of application No. 08/683,672, Jul. 17, 1996, Pat. No. 5,718,098, which is a continuation-in-part of application No. 08/368,275, Dec. 30, 1994, Pat. No. 5,568,866.

[51] Int. Cl.[6] ..... B65D 75/26

[52] U.S. Cl. ..... 206/466; 206/460; 206/484; 206/823

[58] Field of Search ..... 206/460, 466, 206/484, 581, 813, 823; 283/56

[56] References Cited

U.S. PATENT DOCUMENTS

| | | | |
|---|---|---|---|
| D. 337,620 | 7/1993 | Ponsi et al. | D20/22 |
| 2,127,081 | 8/1938 | Brown | 40/306 |
| 2,793,743 | 5/1957 | Lefebvre | 206/46 |
| 2,917,165 | 12/1959 | Kehr | 206/47 |
| 3,358,829 | 12/1967 | Smith et al. | 206/80 |
| 3,540,583 | 11/1970 | Tomlinson | 206/466 |
| 3,809,221 | 5/1974 | Compere | 206/820 |
| 3,837,565 | 9/1974 | Johnsen | 229/68 R |
| 4,055,672 | 10/1977 | Hirsch et al. | 426/127 |
| 4,063,641 | 12/1977 | Kuehn et al. | 206/484 |
| 4,105,116 | 8/1978 | Jones et al. | 206/484 |
| 4,234,084 | 11/1980 | Hutten | 206/306 |
| 4,285,430 | 8/1981 | Caunt | 206/471 |
| 4,411,364 | 10/1983 | Friedman | 206/466 |
| 4,557,381 | 12/1985 | Whitney | 206/440 |
| 4,597,765 | 7/1986 | Klatt | 623/11 |
| 4,621,442 | 11/1986 | Mack | 40/2 R |
| 4,621,837 | 11/1986 | Mack | 283/105 |
| 4,666,040 | 5/1987 | Murata | 206/441 |
| 4,807,806 | 2/1989 | Nieman | 229/92.8 |
| 4,868,027 | 9/1989 | Hunkeler et al. | 428/42 |
| 4,890,739 | 1/1990 | Mize, Jr. et al. | 206/459 |
| 4,923,063 | 5/1990 | Tararuj | 206/484 |
| 4,941,574 | 7/1990 | Meehan | 206/466 |
| 5,031,762 | 7/1991 | Heacox | 206/210 |
| 5,062,569 | 11/1991 | Hekal | 229/3.5 R |
| 5,072,831 | 12/1991 | Parrotta et al. | 206/823 |
| 5,105,941 | 4/1992 | Dolan et al. | 206/232 |
| 5,161,688 | 11/1992 | Muchin | 206/484 |
| 5,192,386 | 3/1993 | Moir et al. | 156/268 |
| 5,257,692 | 11/1993 | Heacox | 206/210 |
| 5,262,214 | 11/1993 | Instance | 428/40 |
| 5,290,616 | 3/1994 | Cowan et al. | 428/40 |
| 5,399,503 | 3/1995 | Instance | 428/40 |
| 5,470,418 | 11/1995 | Instance | 156/231 |
| 5,605,730 | 2/1997 | Treleaven | 428/40.1 |

FOREIGN PATENT DOCUMENTS

| | | | |
|---|---|---|---|
| 525530 | 2/1993 | European Pat. Off. | 206/484 |

OTHER PUBLICATIONS

Champagne Parfum Fold–Over Sample, no date.

*Label Company Samples a New Niche*; Converting Magazine, Nov., 1994, pp. 62, 64, 66.

*Primary Examiner*—Jim Foster

*Attorney, Agent, or Firm*—Myers Bigel Sibley & Sajovec

[57] ABSTRACT

A package for carrying fluid or powder samples and which is well adapted for application to product packaging or cards using automated equipment, and methods for forming the same. The package may be produced using a support web, a web of double coated tape, a web of transfer tape, or a release liner and a self-adhesive laminate. Unique nip rollers are disclosed for over-laminating the pouches and for guiding the web with pouches thereon for packaging.

20 Claims, 8 Drawing Sheets

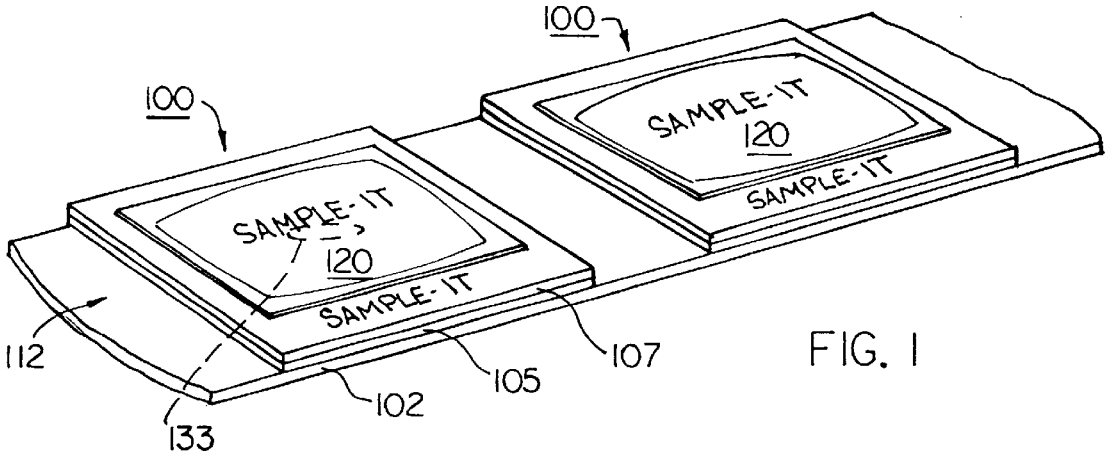
FIG. 1
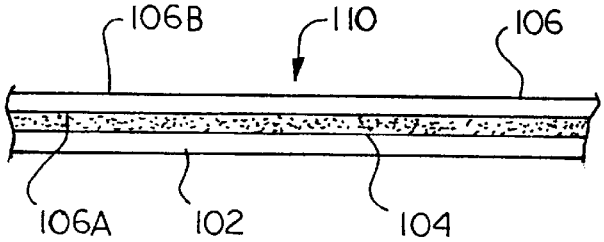
FIG. 2
FIG. 3
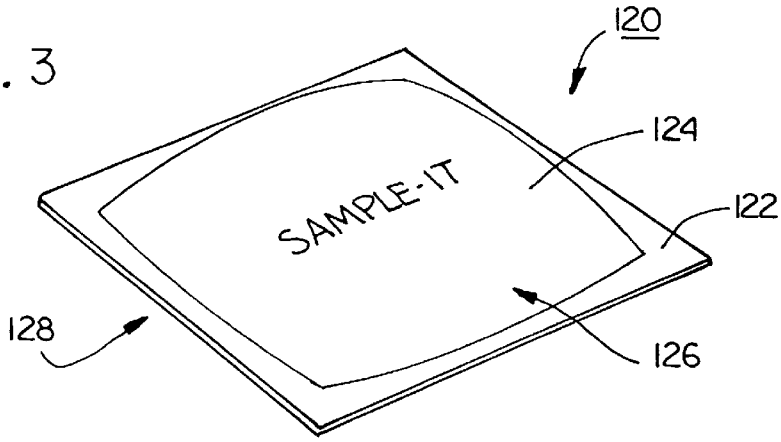

SAMPLE PACKAGE

This is a divisional application of Application Ser. No. 08/979,232, filed Nov. 21, 1997, now U.S. Pat. No. 5,842, 324, which is a divisional application of Ser. No. 08/683, 672, filed Jul. 17, 1996, now U.S. Pat. No. 5,718,098, which is a continuation-in-part application of Application Ser. No. 08/368,275, filed Dec. 30, 1994, now U.S. Pat. No. 5,568, 866, the disclosures of which are hereby incorporated by reference in their entireties.

FIELD OF THE INVENTION

The present invention is directed to packages for carrying fluid or powder samples as well as irregularly shaped objects, granules, and tablets, and, more particularly, to a convenient and cost-effective package which may be more easily affixed to mailing cards or containers.

BACKGROUND OF THE INVENTION

Today, many manufacturers are looking for new ways to promote new and exciting products. For example, many personal care product manufacturers send samples on mailing cards to prospective customers. Additionally, such companies often shrink wrap samples to existing product packaging. For example, a sample of hair conditioner may be shrink wrapped to a package of hair shampoo. Referred to as "cross-selling," these free samples are intended to entice prospective customers to try the sample products and to buy the products in the future.

Presently, it is known to shrink wrap or to use hot glue to adhere samples to cards or packages associated with products. Additionally, several sampler packaging designs have been developed. See, for example, U.S. Pat. No. 4,105,116 to Jones et al., U.S. Pat. No. 4,234,084 to Hutten, U.S. Pat. No. 4,285,430 to Caunt, U.S. Pat. No. 4,890,739 to Mize, Jr., et al., U.S. Pat. No. 4,923,063 to Tararuj, U.S. Pat. No. 4,941,574 to Meehan, U.S. Pat. No. 5,161,688 to Muchin, and U.S. Pat. No. 5,192,386 to Moir et al. All of the above-disclosed methods and designs suffer from inefficiency or prohibitive expense in manufacture or in application with automated materials handling equipment. For example, shrink wrapping and hot gluing require specialized and dedicated application machinery, the application process being inefficient and expensive. Moreover, these methods are inconvenient in that the packaging to which the sample is to be affixed must be brought into contact with the requisite equipment. Each of the methods and designs disclosed in the above-referenced patents are complex and/or not well adapted to mass application to product packaging.

Thus, there exists a need for a cost-effective package for affixing fluid or powder sample goods as well as irregularly shaped objects (e.g., dental floss), granules, and tablets to product packaging, cards, flexible packages, and the like, which may be efficiently mass-produced and applied to such product packaging and cards. Moreover, there exists a need for a package as described above which may be manufactured and applied to packaging using conventional equipment. There exists a need for a method for forming such a package.

SUMMARY OF THE INVENTION

The present invention is directed to a package for carrying fluid or powder samples as well as irregularly shaped objects (e.g., dental floss), granules, and tablets to product packaging, cards, flexible packages, and the like, which is well adapted for application to product packaging or cards using standard dispensing equipment or the like. The package may be produced using (1) a support web having a base web, (2) a web of double coated tape, (3) a web of transfer tape, or (4) a release liner and a self-adhesive laminate web.

Packages produced using a support web having a base web are constructed as follows. A support web of indeterminate length includes a plurality of base patches each having an upper surface and a lower surface. The lower surface of each patch is coated with a layer of self-adhesive. The patch is releasably secured to the upper surface of a release liner by the self-adhesive. At least one pliable pouch containing the sample goods is secured to the upper face of each patch.

Each pouch may be secured by its lower face to the upper surface of the respective patch by adhesive.

Alternatively, the patch may include tabs, each of which extend beyond the perimeter of a respective pouch. In the alternative approach, each respective pouch is secured to the upper surface of the patch by a laminate cover. The laminate cover covers a portion of the respective pouch and is secured to the tabs by adhesive. As a further alternative, laminated packages as just described may be further provided with adhesive between the lower face of the pouch and the upper surface of the patch.

Packages using the support web having a base web may be produced according to the following method. A support web having a base web, and as described above, is unwound. A pliable pouch containing a fluid or powder sample is placed and secured on the upper surface of the base web by means of adhesive. The support web is cut down to the release liner forming the base patch.

The step of securing the pouch to the upper surface of the base web may include applying adhesive to one of the upper surface of the base web and the lower surface of the pouch prior to the step of placing the pouch on the base web.

Alternatively, the step of securing the pouch to the upper surface of the base web may include applying a laminate web over at least a portion of the pouch, the laminate web secured by adhesive to a portion of the base web extending beyond the perimeter of the pouch.

As a further alternative, the step of securing as just described may further include applying adhesive to one of the upper surface of the base web and the lower surface of the pouch prior to the step of placing the pouch on the base web.

Packages produced using a web of double coated tape are constructed as follows. The web of double coated tape includes a plurality of patches each including a relatively thin carrier having an upper surface and a lower surface. The lower surface of the carrier is coated with a first adhesive layer and the upper surface of the carrier is coated with a second adhesive layer. The carrier is releasably secured to the upper surface of a release liner by the first adhesive layer. At least one pliable pouch is secured to the carrier of each patch by the second adhesive layer.

A laminate cover may be provided over each of the pouches. The laminate cover is secured to the upper surface of the carrier by the second adhesive layer.

Packages using a web of double coated tape may be produced according to the following method. A web of double coated tape as described above is unwound. A pliable pouch containing a sample is placed on the upper surface of the carrier such that the lower surface of the pouch is secured thereto by the second adhesive layer. The tape is cut through the first adhesive layer, the carrier, and the second adhesive layer to form a patch.

The step of placing the pouch may include placing the pouch on the patch.

Furthermore, the method may include the step of applying a laminate web over the pouch and the upper surface of the carrier so that the laminate web is secured to the carrier by the second adhesive layer.

Packages produced using a web of transfer tape are constructed as follows. The web of transfer tape includes a release liner having an upper surface and a plurality of adhesive patches thereon. At least one pliable pouch containing the sample and having a lower face is secured to each patch. The adhesive patch is interposed between the upper surface of the release liner and the lower face of the pouch. Each of the pouches is releasably secured to the upper surface of the release liner by its respective adhesive patch.

Each package may be provided with a laminate cover which covers the pouch and is secured to the upper surface of the release liner by the adhesive patch.

Packages produced using a web of transfer tape may be produced according to the following method. A web of transfer tape including a release liner and an adhesive layer is unwound. The pliable pouch is placed on the upper face of the release liner such that the lower face of the pouch is releasably secured thereto by the adhesive layer. The tape is cut through the adhesive layer to form a patch.

The step of placing the pouch may include placing the pouch on the patch.

Furthermore, a laminate web may be applied over the pouch and the upper surface of the release liner such that the laminate web is secured to the release liner by the adhesive layer.

Packages produced using a release liner and a self-adhesive laminate web are constructed as follows. The package includes a release liner having an upper surface. A pliable pouch having upper and lower faces and containing a sample good is provided. The pouch is disposed on the upper surface of the release liner such that the lower face of the pouch directly engages the upper surface of the release liner. A self-adhesive laminate cover having a lower surface overlies the pouch and the release liner. The lower surface of the laminate cover is coated with a laminate adhesive. A first portion of the lower surface of the laminate cover is adhered to the upper face of the pouch by the laminate adhesive and a second portion of the lower surface of the laminate cover is releasably and directly adhered to the upper surface of the release liner by the laminate adhesive.

The package as just described may further include a second adhesive disposed between the lower face of the pouch and the upper surface of the release liner. The second adhesive releasably secures the pouch to the release liner.

Packages produced using a release liner and a self-adhesive laminate web may be produced according to the following method. A release liner having an upper surface is unwound. A pliable pouch having upper and lower faces and containing a sample good is placed on the upper surface of the release liner. The pouch is placed such that the lower face of the pouch directly engages the upper surface of the release liner. A self-adhesive laminate web having a laminate adhesive on a lower surface thereof is applied over the pouch. The laminate web is applied such that a first portion of the laminate web is adhered to the upper surface of the pouch by the laminate adhesive and a second portion of the laminate web is releasably adhered to the upper surface of the release liner by the laminate adhesive.

The above described method may further include the step of cutting the laminate web down to the upper surface of the release liner to form cut lines to define peripheries of the sample packages. The peripheries define therein at least one tab portion forming a part of the laminate web and releasably adhered to the upper surface of the release liner by the laminate adhesive.

Prior to the step of placing the pouch, an adhesive dot may be applied to the upper surface of the release liner at a location corresponding to the placement of the pliable pouch. In such case, the step of placing the pliable pouch includes placing the pouch on the adhesive dot so that at least a portion of the lower surface of the pouch is temporarily secured to the upper surface of the release liner.

The method may further include the step of marrying the laminate web to the pouch and to the upper surface of the release liner. The step of marrying includes passing the release liner, the pouch, and the laminate web beneath a nip roller, the nip roller having a durometer in the range of about 10 to about 90.

Additionally, the package may be packaged. The step of packaging includes passing the release liner with a portion of the laminate web and the pouch thereon beneath a guide roller. The guide roller has a concave periphery adapted to receive the pouch.

In each of the above-described methods, lamination of the pouches to the desired substrate may be facilitated by passing the support web, the double coated tape, the transfer tape, or release liner and laminate and each of the pouches beneath a relatively soft nip roller, the nip roller having a durometer in the range of about 10 to about 90.

Furthermore, in each of the methods described above utilizing a laminate web, the laminate web may be secured onto or over each pouch and to the adjacent adhesive or release liner by passing the support web, double coated tape, or transfer tape, the laminate web, and the pouch beneath a relatively soft nip roller, the nip roller having a durometer in the range of about 10 to about 90. Each of the above-described packages may be packaged by passing the support web, double coated tape, transfer tape, or release liner and laminate with the pouch thereon beneath a guide roller, the guide roller having a concave periphery adapted to receive the pouches.

An object of the present invention is to provide a package for carrying fluid or powder samples, as well as irregularly shaped objects, tablets, granules, and the like.

An object of the present invention is to provide a package for carrying fluid or powder samples, as well as irregularly shaped objects, tablets, granules, and the like, which may be conveniently and cost-effectively affixed to product packaging, cards, and the like.

An object of the present invention is to provide a package as described above which may be affixed to product packaging, cards, and the like using standard automated materials handling equipment.

An object of the present invention is to provide a package as described above and a method for producing the same which may be practiced using substantially conventional package production equipment which has been conveniently and cost-effectively modified.

The foregoing and other objects of the present invention will be appreciated upon reading the detailed description of the invention which follows, the embodiments disclosed therein being by way of example only.

BRIEF DESCRIPTION OF THE DRAWINGS

FIG. 1 it perspective view of packages according to a first embodiment of the present invention.

FIG. 2 is a side elevational view of the support web of the present invention.

FIG. 3 is a perspective view of a pouch containing sample goods according to the present invention.

DETAILED DESCRIPTION OF THE INVENTION

Figure 4:
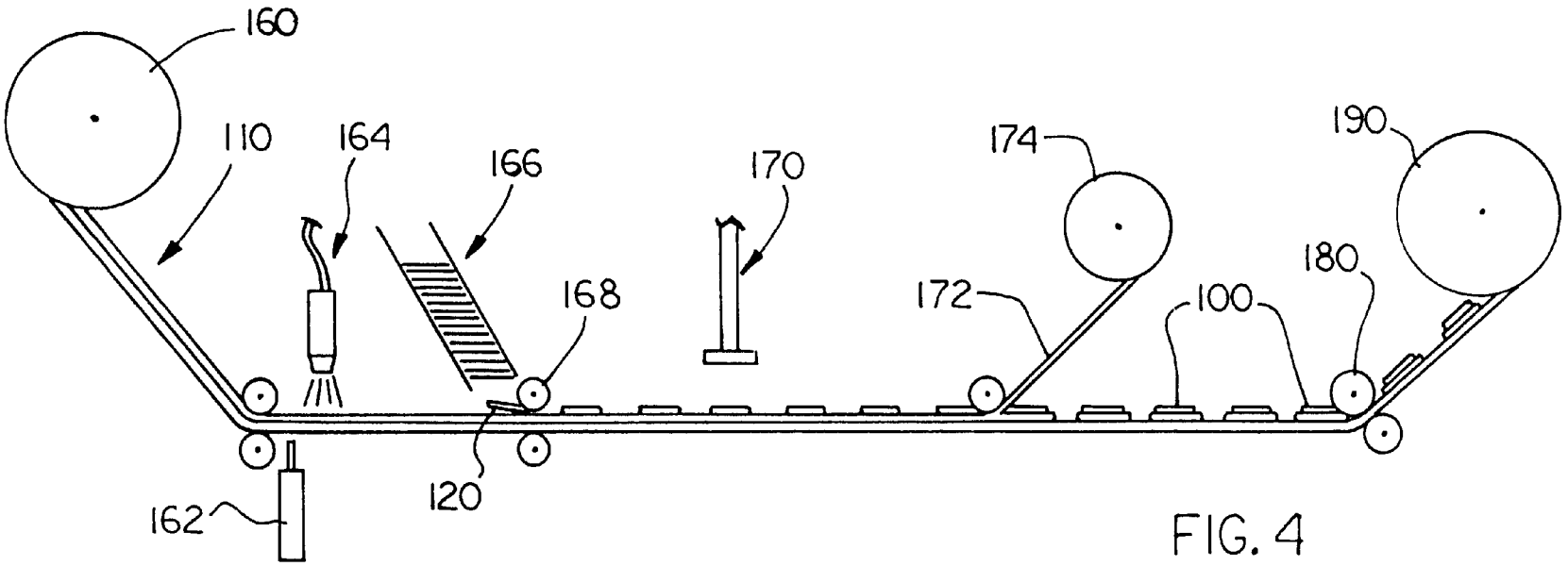
FIG. 4 is diagrammatic side elevational view of an apparatus adapted to produce the packages of FIG. 1.

Packages for carrying samples according to the present invention may be produced using a support web, a web of transfer tape, or a web of double coated tape. In each case, packages are provided having pressure sensitive, self-adhesive backing such that they may be applied to packaging, cards, or the like using conventional automated material handling equipment.

Packages 100 according to a first embodiment of the present invention, as best seen in FIGS. 1–4A, may be produced using a support web 110. Support web 110, as shown in FIG. 2 may be, for example, Fasson Fastrip 2 mil polyester liner. Support web 110 includes base web 106 having upper surface 106B and lower surface 106A. Pressure sensitive adhesive 104 releasably adheres base web 106 to release liner 102.

Each package 100 includes a patch 112 disposed on release liner 102 and supporting a pouch 120. Patch 112 includes base patch 107 which is releasably secured to release liner 102 by pressure sensitive adhesive patch 105. Pouch 120 is secured to the upper surface of base patch 107 by adhesive spot 133 interposed therebetween. Preferably, base patch 107 is provided with a print region 130 on its upper surface for printing identification or information regarding the sample goods.

Pouch 120, as best seen in FIG. 3, includes upper face 126 and lower face 128. Sealed border region 122 surrounds containment region 124. Fluid or powder sample goods, for example, may be contained in containment region 124. Pouches 120 are preferably formed of a pliable material such as paper or foil, and may be, by way of example, 48 pound-gauge polyester, 9 pound low density polyethylene, 0.000285 foil, 9 pound EAA, 9 pound linear low density polyethylene/low density polyethylene blend.

With reference to FIG. 4, packages 100 according to the first embodiment may be produced as follows. Support web 110 is unwound from unwinding station 160. Preferably, an electronic eye 162 is provided to read eye marks on the web and thereby control the progress of the web in conjunction with the actuation of subsequent operation stations. Adhesive application station 164 selectively coats the upper surface of web 110 to provide dots or strips of adhesive 133 corresponding to the locations at which pouches 120 are to be placed. Pouch application station 166, for example, an Onserter OS700-TM-2, in conjunction with nip roller 168 apply and laminate pouch 120 to web 110. The construction is then diecut by cutting station 170 down to release liner 102 forming patches 112. Waste matrix 172 consisting of the portions of base web 106 and adhesive 104 not within the perimeters of the diecut is removed by winding station 174. Packages 100 are then wound onto a roll by winding station 190 and guide roller 180.

It will be appreciated that laminating pouches 120 to support web 110 provides unique problems. Whereas a leaflet or printed booklet may be laminated to a support web using a conventional, hard, cylindrical nip roller, such a roller cannot be used advantageously for applying a pouch. The filled pouch does not form a flat plane as does a leaflet or printed booklet. Further, the shape of the pouch is dynamic with respect to the web, i.e., as the pouch is moved, physical forces cause the liquid or other material in the pouch to move, causing the shape of the pouch to change.

The dynamic shape of the pouch makes it difficult to lay the pouch flat onto the moving web. Because the shape of the pouch is dynamic, it is difficult to secure the pouch to the web or, as discussed below with respect to other embodiments of the present invention, it is difficult to lay an over-laminate on the web without causing puckering. As the construction passes through a conventional nip roller, the pressure provided by the nip roller will either be inadequate or excessive. If the pressure is inadequate, the pouch will not lay down properly against the base web. If the pressure is excessive, the pouch will break, causing the contents of the pouch to spill onto the manufacturing equipment.

The foregoing problems are overcome by the use of a soft nip roller 168 according to the present invention. Nip roller 168 has a substantially cylindrical periphery. Nip roller 168 has a durometer in the range of about 10 to about 90, preferably about 40 durometer, depending on the characteristics of the material passing under the roller. The soft nip roller conforms to the shape of the pouch and helps assure that the pouch will adhere to the base web by providing substantially uniform pressure across the pouch. Also, the nip roller minimizes the risk of the pouch rupturing due to excessive pressure.

Figure 4A:
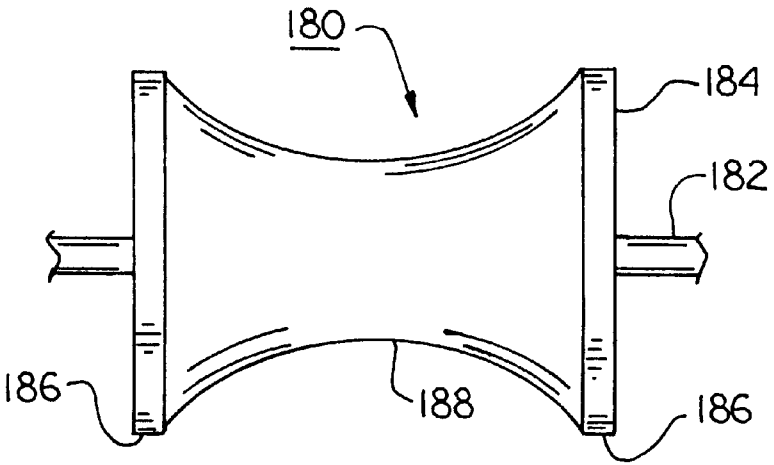
FIG. 4A is a front elevational view of a guide roller according to the present invention.

Exit or guide nip roller 180 is uniquely adapted for guiding packages 100 to winding station 190. As best seen in FIG. 4A, guide nip roller 180 includes roller body 184 which is mounted on driven rod 182. The periphery of roller body 184 includes concave mid-section 188 and flat end sections 186. Nip roller 180 is designed such that end sections 186 engage border regions 122 of pouch 120 and/or portions of the web extending laterally beyond the pouch, if any, while concave mid-section 188 allows containment region 124 of pouch 120 to pass therethrough with no pressure or resistance, or with a controlled amount of pressure or resistance. Preferably, guide nip roller 180 will have a durometer in the range of about 10 to about 90.

Figure 5:
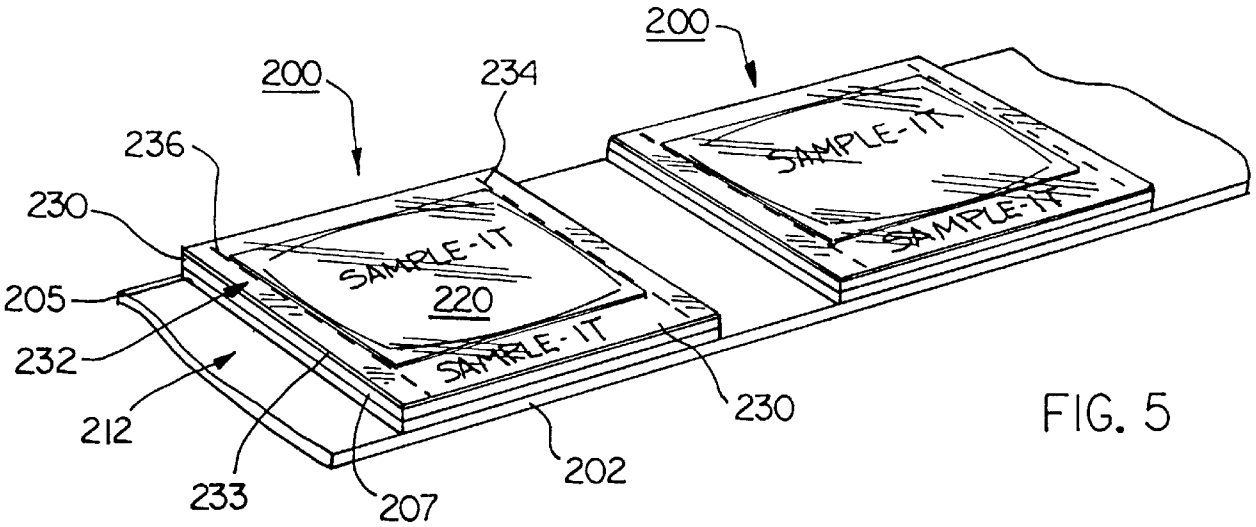
FIG. 5 is a perspective view of a series of packages according to a second embodiment of the present invention.

Each package 200 according to a second embodiment of the present invention, as best seen in FIG. 5, includes laminate cover 232. Elements 202, 205, 207, 212, 220 and 230 correspond to elements 102, 105, 107, 112, 120 and 130 of the first embodiment. Patch 212 includes tabs 230 which extend beyond the perimeter of pouch 220 and which may include identifying information imprinted thereon. Laminate cover 232 covers pouch 220 and is secured to base patch 207 and the upper face of pouch 220 by adhesive 233. Tear lines 234, 236 are provided in laminate cover 232 to facilitate removal of pouch 220 from package 200.

Figure 6:
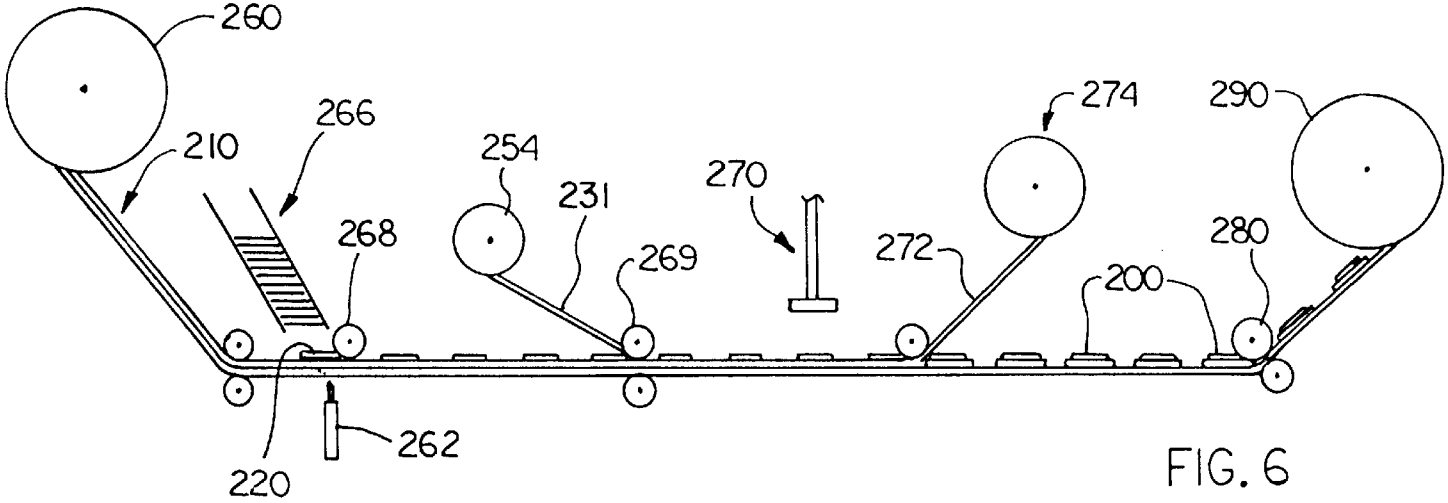
FIG. 6 is a diagrammatic side elevational view of an apparatus adapted to produce the package of FIG. 5.

With reference to FIG. 6, packages according to the second embodiment may be produced as follows. Support web 210 corresponding to support web 110 of the first embodiment is unwound from unwinding station 260. Preferably, an electric eye 262 is provided corresponding to electric eye 162 of the first embodiment. Pouches 220 are placed on support web 210 by pouch application station 266 in conjunction with nip roller 268. Nip roller 268 is preferably of the same construction as nip roller 168 discussed above. Laminate web 231, coated with adhesive on its underside, is unwound from unwinding station 254. Soft nip roller 269, constructed as discussed above with regard to nip rollers 168 and 268, serves to over-laminate laminate web 231 over pouches 220 and support web 210. Cutting station 270 diecuts patches 212 down to the release liner. Waste matrix 272 consisting of the portions of laminate web 231, support web 210 (excluding the release liner), and adhesive 233 not within the perimeter of patch 212 is removed by winding station 274. Packages 200 are then wound onto a roll by winding station 290 in conjunction with guide roller 280. Guide roller 280 is preferably constructed as discussed above with regard to guide nip roller 180.

Figure 7:
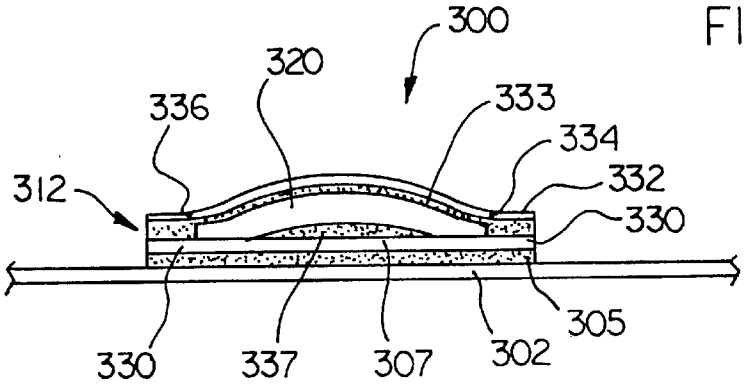
FIG. 7 is a fragmentary, side cross-sectional view of a package according to a third embodiment of the present invention.

Each package 300 according to a third embodiment of the present invention, as best seen in FIG. 7, includes a laminate cover 332 corresponding to laminate cover 232 of the second embodiment. Additionally, an adhesive spot 337 is provided corresponding to adhesive 133 of the first embodiment. Elements 302, 305, 307, 312, 320, 333, 334 and 336 correspond to elements 202, 205, 207, 212, 220, 233, 234 and 236 of the second embodiment.

Figure 8:
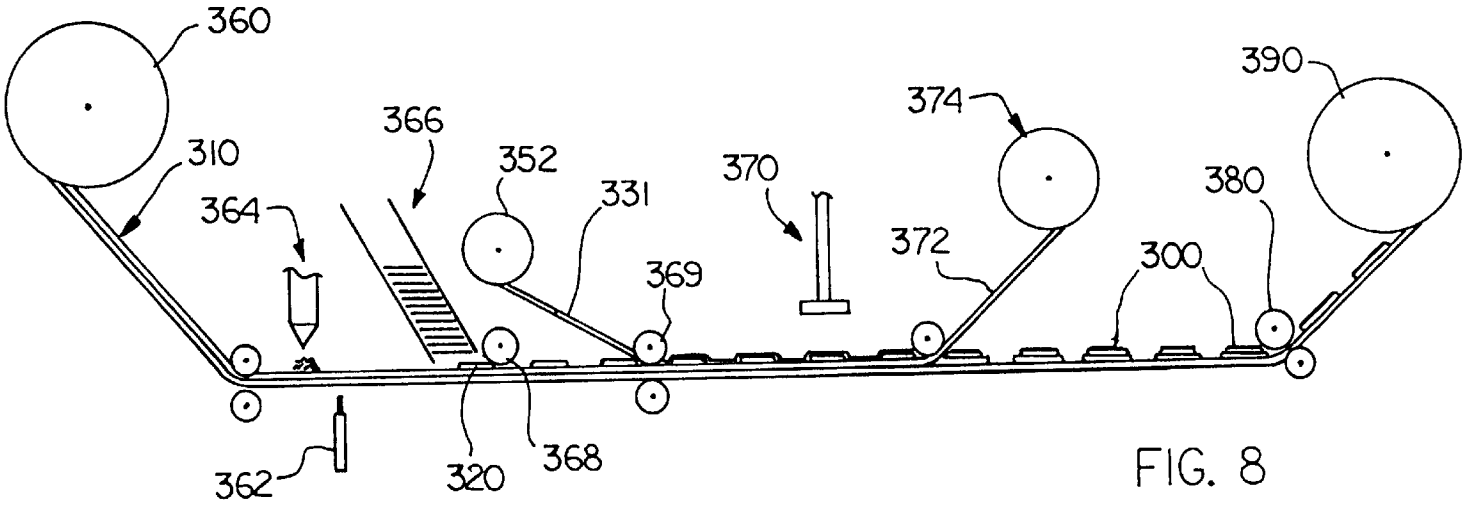
FIG. 8 is a diagrammatic side elevational view of an apparatus adapted to produce the packages of FIG. 7.

With reference to FIG. 8, packages 300 according to the third embodiment may be produced as follows. A support web 310 corresponding to support web 110 of the first embodiment is unwound by unwinding station 360. Preferably, an electric eye 362 corresponding to electric eye 162 of the first embodiment is provided. Adhesive application station 364 applies spots of adhesive 337 to support web 310 corresponding to the locations at which pouches 320 are to be affixed. Pouch application station 366 in conjunction with nip roller 368 applies pouches 320 to support web 310. Nip rollers 368 and 369 (as discussed below) are constructed as described above with regard to nip roller 168. Unwinding station 352 in conjunction with nip roller 369 applies laminate web 331 (the underside of which is coated with adhesive 333) over pouches 320 and support web 310. Cutting station 370 cuts patches 312. Waste matrix 372 consists of the portions of support web 310 (excluding the release liner), adhesive 333, and laminate web 331 not within the perimeters of patches 312 is removed by winding station 374. Packages 300 are then wound onto a roll by winding station 390 in conjunction with guide nip roller 380. Guide nip roller 380 is constructed as discussed above regarding guide nip roller 180.

As an alternative to using a laminate web having adhesive on its underside, adhesive spot 337 may be formed by adhesive application station 364 so as to extend beyond the perimeter of pouch 320, onto tabs 330. After pouch 320 is applied, the laminate web is over-laminated and adheres to the adhesive located on tabs 330 outside the perimeter of pouch 320.

The base webs of support webs 110, 210, 310 may be made of paper, opaque film, clear film, or any suitable material. In the cases of the second and third embodiments, if the base patch is printed, a banding of varnish should be applied to protect the graphics from lamination strip-off.

Figure 10:
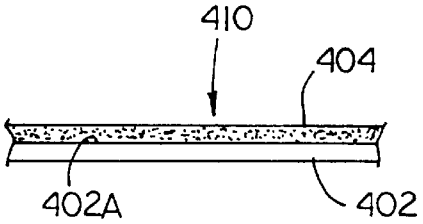
FIG. 10 is a side elevational view of a section of the transfer tape of the present invention.
Figure 9:
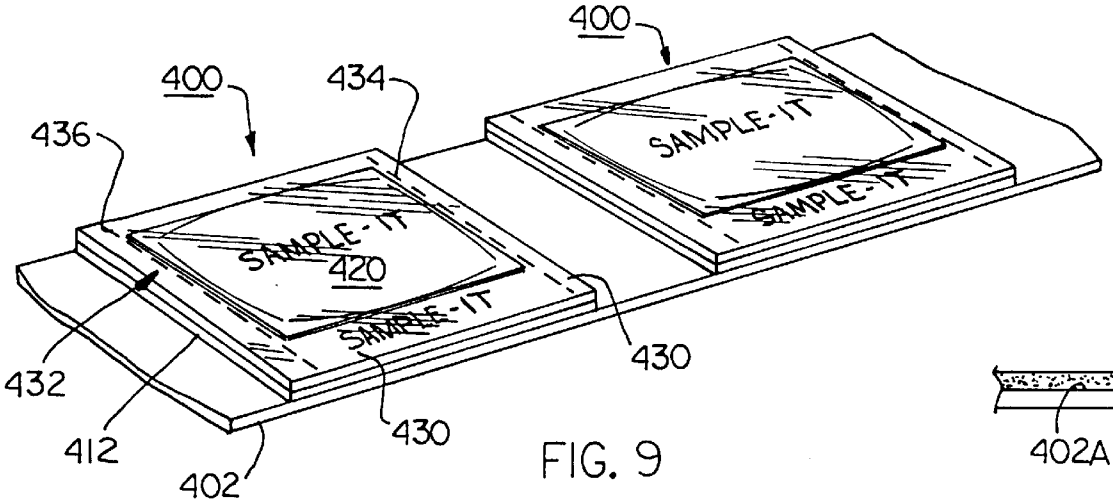
FIG. 9 is a perspective view of a package according to a fourth embodiment of the present invention.

Packages 400 according to a fourth embodiment of the present invention, as best seen in FIG. 9, are constructed using transfer tape web 410. Transfer tape web 410, as shown in FIG. 10, includes release liner 402 having upper surface 402A. Preferably, release liner 402 includes a silicon coating on both sides. A coating of pressure sensitive adhesive 404 is releasably secured to upper surface 402A of the release liner. Transfer tape such as 3M Product No. 9447, 1 millimeter High-Tenacity Tape with 320 adhesive is exemplary of one product which may be used. Transfer tapes having a second release liner layer located on adhesive layer 404 may also be used. Note that the relative size of the tape and thickness of the adhesive layer have been exaggerated in the drawings for the sake of clarity. Preferably, adhesive layer 404, which remains with package 400 as adhesive patch 412 when the same is removed from release liner 402, will appear as a thin adhesive film on the lower face of pouch 420.

Package 400 includes adhesive patch 412 formed from adhesive layer 404 of transfer tape web 410. Pouch 420 is secured to the upper surface 402A of the release liner by adhesive patch 412. Laminate cover 432 covers patch 412 and pouch 420. Laminate cover 432 is secured to pouch 412 by the portions of adhesive patch 412 located at tabs 430. Optional tear lines 434, 436 are provided to facilitate access to and removal of pouch 420.

Figure 11:
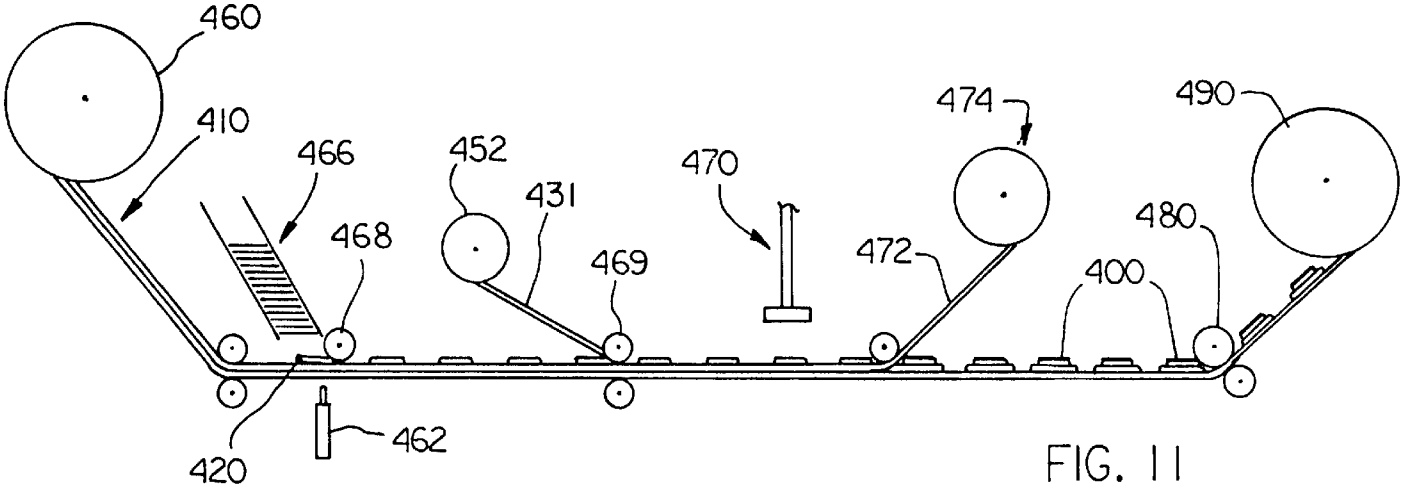
FIG. 11 is a diagrammatic side elevational view of an apparatus adapted to produce the packages of FIG. 9.

With reference to FIG. 11, packages according to the fourth embodiment may be produced as follows. Transfer tape 410 is unwound by unwinding station 460. Preferably, an electric eye 462 is provided corresponding to electric eye 162 of the first embodiment. Pouches 420 are applied to web 410 by pouch application station 466 in conjunction with soft nip roller 468. Nip rollers 468 and 469, as discussed below, are constructed as discussed above with respect to nip roller 168 of the first embodiment. Laminate web 431 is applied over pouches 420 and transfer tape web 410 by unwinding station 452 in conjunction with nip roller 469. Cutting station 470 diecuts patches 412. Waste matrix 472 consisting of the portions of laminate web 431 and tape web 410 (excluding the release liner) not within the perimeters of patches 412 is removed by winding station 474. Packages 400 are then wound onto a roll by winding station 490 in conjunction with guide nip roller 480. Nip roller 480 is constructed as discussed above with respect to nip roller 180 of the first embodiment.

As an alternative to unrolling prefabricated transfer tape as described above, the transfer tape may be formed as part of the package forming process. First, a release liner is unwound and the upper surface thereof is coated with pressure sensitive adhesive by a coating station (not shown). The transfer tape thus formed is thereafter manipulated as described above.

Figure 13:
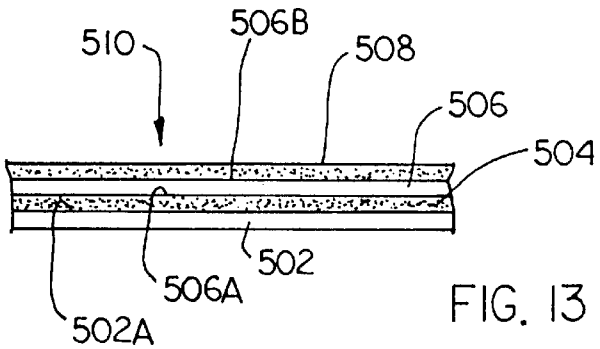
FIG. 13 is a side elevational view of a section of the double coated tape of the present invention.
Figure 12:
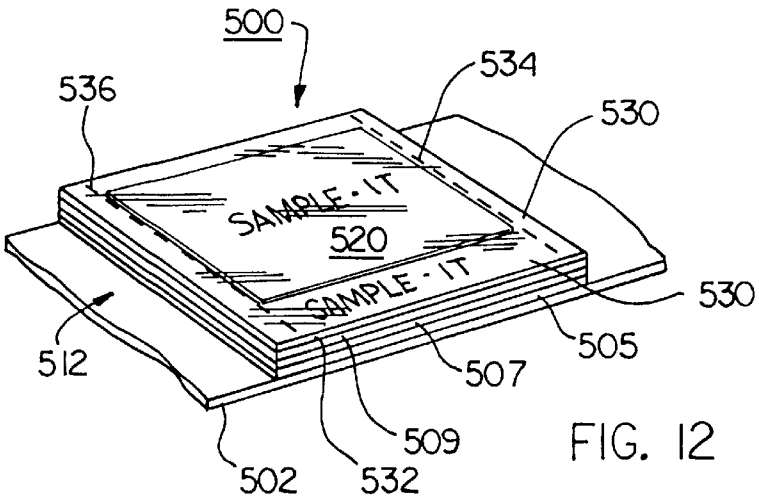
FIG. 12 is a perspective view of a package according to a fifth embodiment of the present invention.

A fifth embodiment according to the present invention, as best seen in FIG. 12, is produced using a web of double coated tape 510. Double coated tape such as 3M Scotch Brand Tape, Product No. 9458 is exemplary of one product which may be used. Double coated tape 510, as best seen in FIG. 13, includes carrier 506 which has an upper surface 506B and a lower surface 506A. Carrier 506 is preferably formed from a polypropylene substrate having a thickness of between 0.5 mil (0.0005 inch) and 4.5 mils (0.0045 inch). Lower surface 506A of the carrier is coated with first adhesive layer 504. Upper surface 506B of the carrier is coated with second adhesive layer 508. Adhesive layers 504, 508 are preferably formed from pressure sensitive adhesive. Double coated tape 510 further includes release liner 502 which has an upper surface 502A. Carrier 506 is releasably secured to upper surface 502A of the release liner by first adhesive layer 504. Double coated tapes having a second release liner layer located on second adhesive layer 508 may also be used. Note that the relative size of the tape and thickness of the layers has been exaggerated in the drawings for the sake of clarity. Preferably, layers 504, 506, and 508, which remain with package 500 as elements 505, 507, and 509, respectively, when the same is removed from release liner 502, will appear as a thin adhesive film on the lower face of pouch 520.

Package 500 includes patch 512 formed from double coated tape 510 and includes first adhesive layer 505, carrier 507, and second adhesive layer 509. Pouch 520 is secured to the upper surface of carrier 507 by second adhesive layer 509. Laminate cover 532 covers patch 512 and pouch 520 and is secured to patch 512 at tabs 530 by second adhesive layer 509. Optional tear lines 534, 536 are provided to facilitate access to and removal of pouch 520.

Figure 14:
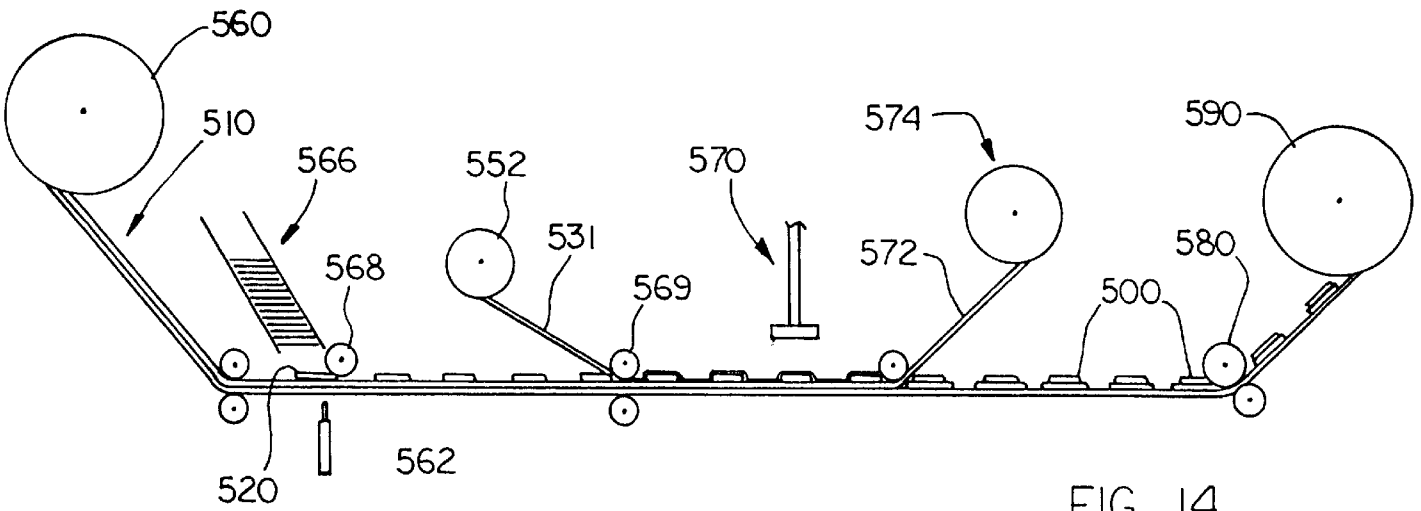
FIG. 14 is a diagrammatic side elevational view of a apparatus adapted to produce the packages of FIG. 12.

With reference to FIG. 14, packages 500 may be produced as follows. Double coated tape web 510 is unwound by unwinding station 560. Preferably, an electronic eye 562 corresponding to electronic eye 162 of the first embodiment is provided. Pouches 520 are placed on web 510 by pouch application station 566 in conjunction with nip roller 568. Nip rollers 568 and 569, as discussed below, are constructed as described above with respect to nip roller 168 of the first embodiment. Laminate web 531 is applied over web 510 and pouches 520 by unwinding station 552 and nip roller 569. Cutting station 570 diecuts patches 512. Waste matrix 572 consisting of the portions of laminate web 531 and tape web 510 (excluding the release liner) not within the perimeters of patches 512 is removed by winding station 574. Packages 500 are wound onto a roll by winding station 590 in conjunction with guide or exit nip roller 580. Nip roller 580 is constructed as discussed above with respect to guide roller 180 of the first embodiment. In each of the above-described embodiments, the packages may be fan-folded as an alternative to rewinding onto a roll. Moreover, it will be appreciated that packages according to any of the above-described methods can be packaged by winding or fan-folding without exposing the upper faces of the pouches to exposed, activated adhesive, because all of the adhesive not covered by the pouches is covered by the laminate covers.

In each of the methods described above, if a transfer tape or double coated tape of the type having a second release liner is used, the second liner will be removed as a part of the unwinding step.

Figure 15:
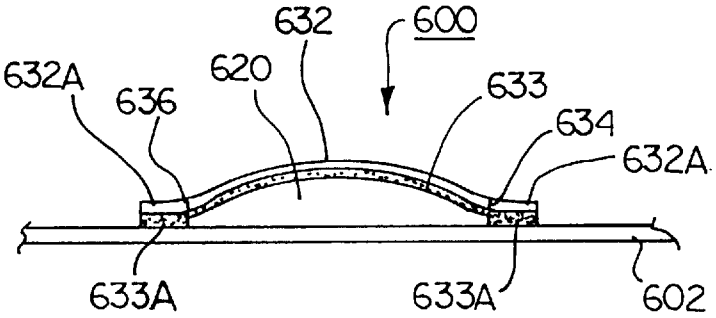
FIG. 15 is a fragmentary, side cross sectional view of a package according to a sixth embodiment of the present invention.

With reference to FIG. 15, a package 600 according to a sixth embodiment is shown therein disposed on a release liner 602. FIG. 15 is a cross sectional view, except that pouch 620 forming a part of label 600 is not shown in cross section. Pouch 620 corresponds to pouch 120 as described above. Self-adhesive laminate cover 632 overlies pouch 620 and portions of release liner 602. Laminate cover 632 has tabs 632A which extend beyond the edges of pouch 620. Preferably, pouch 620 and laminate cover 632 are relatively configured such that laminate cover 632 has tabs 632A on all sides and surrounding pouch 620 as shown for labels 200 (FIG. 5), 300 (FIG. 7), 400 (FIG. 9), and 500 (FIG. 12). Laminate cover 632 has disposed on its undersurface pressure sensitive adhesive 633. Preferably, the central portion of laminate cover 632 is permanently adhered to the upper surface of pouch 620 by pressure sensitive adhesive 633. Tabs 632A are releasably secured to the upper surface of release liner 602 by tab adhesive portions 633A which form a part of adhesive layer 633. Optionally, tear lines 634, 636 are formed in laminate cover 632 adjacent tabs 632A to facilitate access to pouch 620.

As noted above, tabs 632A surrounding pouch 620 are releasably adhered to the upper surface of release liner 602. Package 600 may be secured to a desired article by removing package 600 from release liner 602 and securing it to the article by means of adhesive portions 633A.

Figure 16:
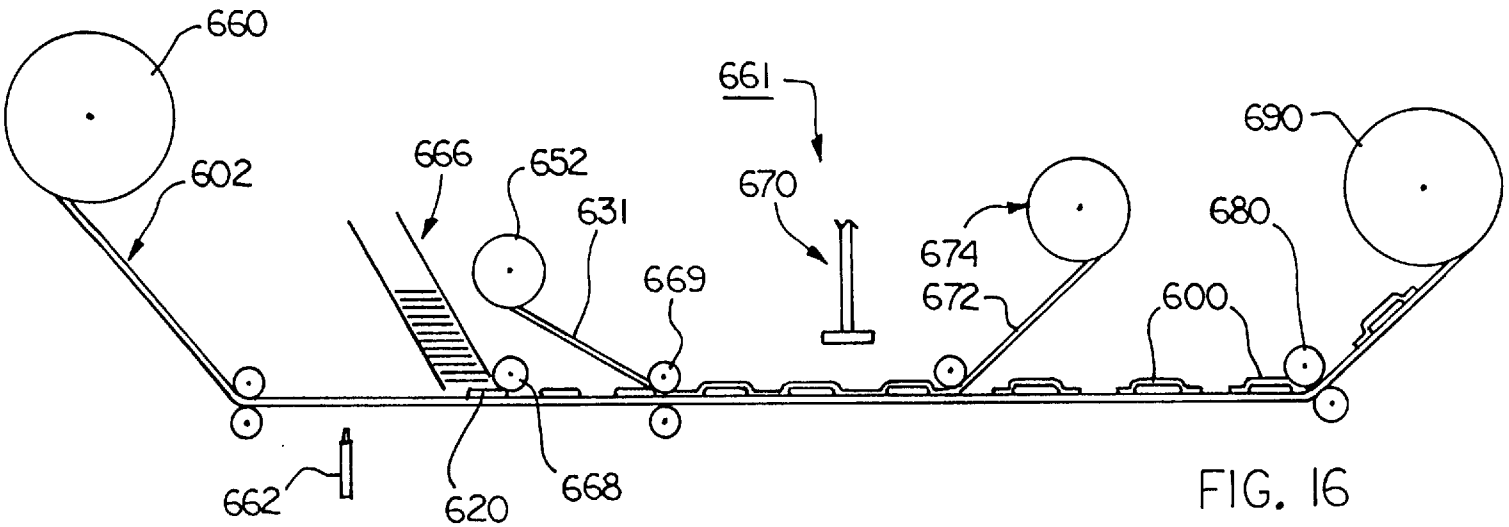
FIG. 16 is a diagrammatic side elevational view of an apparatus adapted to produce the packages of FIG. 15.

With reference to FIG. 16, an apparatus 661 for forming package 600 according to the sixth embodiment is shown therein. Release liner 602 is unwound from unwind station 660. Preferably, release liner 602 is a paper or film web coated on one surface with a silicone coating. Suitable release liners are well known in the art and will be appreciated by those of ordinary skill. Preferably, an electronic eye 662 corresponding to electronic eye 162 of the first embodiment is provided. Pouches 620 are placed on the silicone coated surface of release liner 602 by pouch application station 666 in conjunction with nip roller 668.

Self-adhesive laminate web 631 is applied over release liner 602 and pouches 620 by unwinding station 652 and nip roller 669. Laminate web 631 is preferably a 1 to 1½ mil self wound polypropylene film. Suitable laminate webs are available from Central Products Incorporated of Wisconsin. If the end user desires to imprint on the laminate cover, a non-self wound laminate web is preferred. Examples of non-self wound webs include 2 mil clear polypropylene film such as product number 04324 available from Madico of Woburn, Mass. Nip rollers 668 and 669 are constructed as described above with respect to nip rollers 168 of the first embodiment. It will be appreciated that laminate web 631, once married to booklets 620 and release liner 602 by nip roller 669, will have portions releasably adhered to the release liner and other portions adhered to the top surface of the pouches. The laminate cover is preferably substantially permanently secured to the upper surface of the pouch, although this is not necessary.

Cutting station 670 forms diecuts through self-adhesive laminate web 631 down to release liner 602 defining individual packages 600. Tear lines 634, 636 may be formed by diecut station 670 or a further diecut station (not shown). Waste matrix 672 consisting of the portions of laminate web 631 not within the peripheries of packages 600 is removed by winding station 674. Packages 600 are wound onto a roll by winding station 690 in conjunction with guide or exit nip roller 680. Nip roller 680 is constructed as discussed above with respect to guide roller 180 of the first embodiment.

Figure 17:
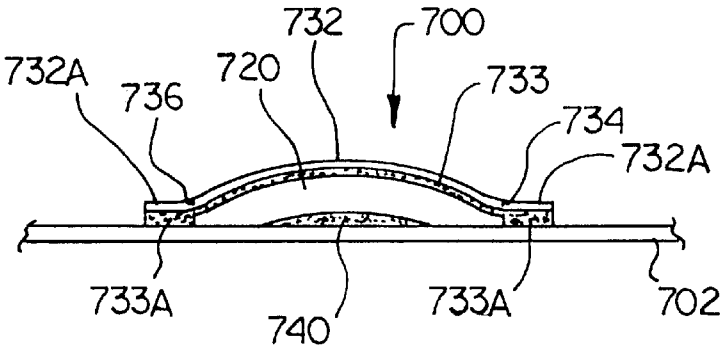
FIG. 17 is a fragmentary, side elevational cross sectional view of a package according to a seventh embodiment of the present invention.

With reference to FIG. 17, a package 700 according to a seventh embodiment of the present invention is shown therein disposed on a release liner 702. Elements 720, 732, 732A, 733, 733A, 734, and 736 correspond to elements 620, 632, 632A, 633, 633A, 634, and 636, respectively, of the sixth embodiment as discussed above. Package 700 differs from package 600 in that it further includes adhesive dot or patch 740. Adhesive 740 is preferably Product No. HL2198-X available from Fuller Adhesives of Charlotte, N.C. Preferably, adhesive 740 is disposed entirely within the periphery of pouch 720. Adhesive 740 will adhere to the container when in use.

Figure 18:
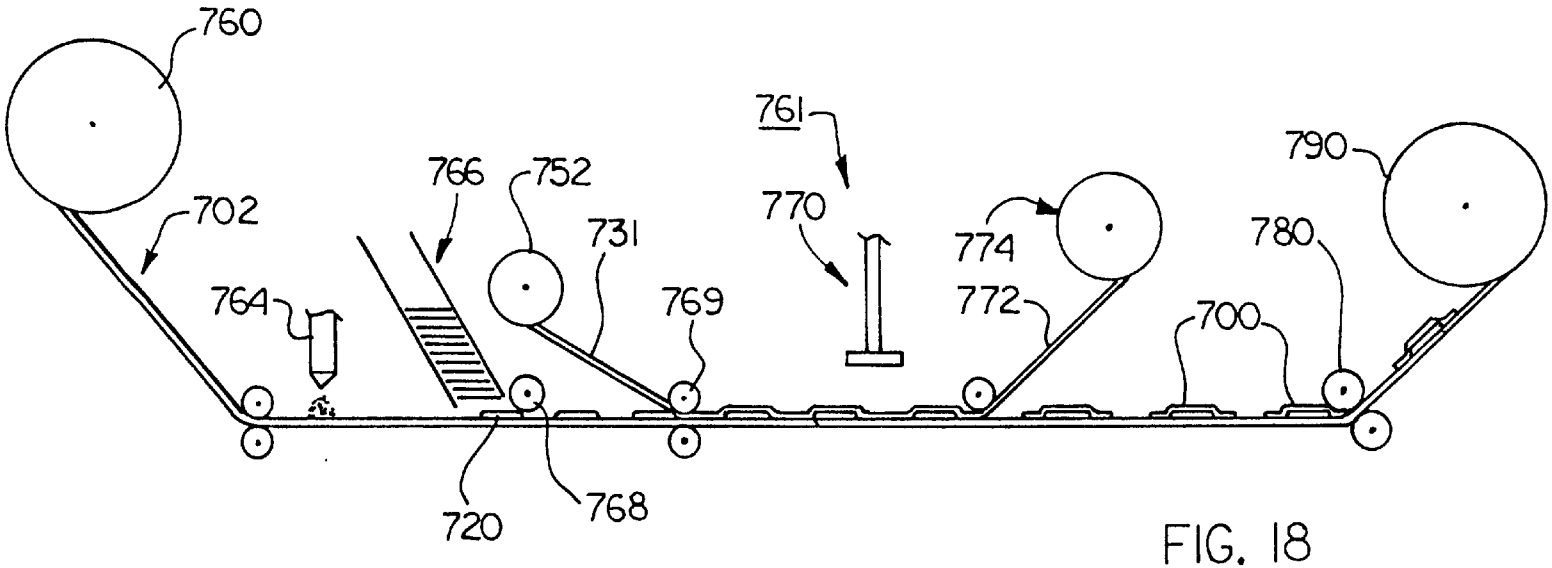
FIG. 18 is a diagrammatic side elevational view of an apparatus adapted to produce the packages of FIG. 17.

Turning now to FIG. 18, an apparatus 761 for forming packages 700 according to the seventh embodiment is shown therein. Apparatus 761 includes elements 731, 752, 760, 762, 766, 768, 769, 770, 772, 774, 780, and 790 corresponding to elements 631, 652, 660, 662, 664, 666, 668, 669, 670, 672, 674, 680, and 690 of the sixth embodiment, respectively. Apparatus 761 further includes adhesive applicator 764 which applies spots of adhesive 740 onto release liner 702 at locations corresponding to the locations at which pouches 720 are to be affixed. Appropriate registry of the adhesive spots corresponding to adhesive 740 and pouches 720 is insured by electronic eye 762. The adhesive spots serve to anchor the respective pouches 720 to release liner 702 prior to application of laminate web 731.

Packages according to each of the above-described embodiments may be produced using "multiple up" pouch constructions. That is, integral pouches may be provided having multiple containment regions divided by border regions. Once the packages have been constructed, the webs with the multiple up pouches thereon may be longitudinally slit, providing a plurality of webs having packages thereon. In the event multiple-up books are used which have oversized border regions between adjacent containment regions, the multiple-up books may be diecut, forming waste portions between respective pouches. The waste portions may be taken up with the waste portions of the laminate web and/or the base web.

Packages according to any of the above-described embodiments, once rewound or fan-folded, may be used with conventional and readily available automatic and semi-automatic packaging machines such as, for example, Labelaire 2111 or Quadrelle Mod 2 machines. Using such machines, a package carrying sample goods may be easily and efficiently applied to the side of a package or card. Moreover, the sample packages may be, by way of example only, blown on, wiped on, or tamped on the package or card.

What is claimed is:

1. An article of manufacture for affixing a sample to an object, comprising:

a. a release liner having an upper surface;

b. a pliable pouch having upper and lower faces and containing a sample good, said pouch disposed on the upper surface of said release liner such that said lower face of said pouch directly engages said upper surface of said release liner; and c. a self-adhesive laminate cover having a lower surface and overlying said pouch and said release liner, said lower surface of said laminate cover coated with a laminate adhesive, a first portion of said lower surface of said laminate cover adhered to said upper face of said pouch by said laminate adhesive and a second portion of said lower surface of said laminate cover releasably and directly adhered to said upper surface of said release liner by said laminate adhesive.

2. The article of claim 1 further including a second adhesive disposed between said lower face of said pouch and said upper surface of said release liner and releasably securing said pouch to said release liner.

3. The article of claim 1 wherein said pouch is adapted to hold at least one of a fluid and a powder.

4. The article of claim 1 including a tear line formed in said laminate cover for accessing said pouch.

5. The article of claim 4 including a second tear line formed in said laminate cover and spaced apart from said first tear line.

6. The article of claim 1 wherein said second portion of said laminate cover substantially entirely surrounds a periphery of said pouch.

7. The article of claim 1 including printed indicia disposed on said article.

8. The article of claim 1 including printed indicia disposed on said laminate cover.

9. An article of manufacture for affixing a sample to an object, comprising:

a. a release liner having an upper surface;

b. a plurality of sample packages disposed on said release liner, each said sample package comprising:

a pliable pouch having upper and lower faces and containing a sample good, said pouch disposed on the upper surface of said release liner such that said lower face of said pouch directly engages said upper surface of said release liner; and a self-adhesive laminate cover having a lower surface and overlying said pouch and said release liner, said lower surface of said laminate cover coated with a laminate adhesive, a first portion of said lower surface of said laminate cover adhered to said upper face of said pouch by said laminate adhesive and a second portion of said lower surface of said laminate cover releasably and directly adhered to said upper surface of said release liner by said laminate adhesive.

10. The article of claim 9 wherein said plurality of sample packages are positioned widthwise across said release liner.

11. The article of claim 9 wherein each of said pouches is adapted to hold at least one of a fluid and a powder.

12. The article of claim 9 wherein each of said sample packages includes a tear line formed in said laminate cover for accessing said pouch.

13. The article of claim 12 wherein each of said sample packages includes a second tear line formed in said laminate cover and spaced apart from said first tear line.

14. The article of claim 9 wherein, in each of said sample packages, said second portion of said laminate cover substantially entirely surrounds a periphery of said pouch.

15. The article of claim 9 including printed indicia disposed on each of said sample packages.

16. The article of claim 9 including printed indicia disposed on each of said laminate covers.

17. An article of manufacture for affixing a sample to an object, comprising:

a. a release liner having an upper surface;

b. a pliable pouch having upper and lower faces and containing a sample good, said pouch disposed on the upper surface of said release liner such that said lower face of said pouch directly engages said upper surface of said release liner;

c. at least one of a fluid and a powder contained in said pouch;

d. a self-adhesive laminate cover having a lower surface and overlying said pouch and said release liner, said lower surface of said laminate cover coated with a laminate adhesive, a first portion of said lower surface of said laminate cover adhered to said upper face of said pouch by said laminate adhesive and a second portion of said lower surface of said laminate cover releasably and directly adhered to said upper surface of said release liner by said laminate adhesive; and e. first and second spaced apart tear lines formed in said laminate cover for accessing said pouch.

18. The article of claim 17 wherein said second portion of said laminate cover substantially entirely surrounds a periphery of said pouch.

19. The article of claim 17 including printed indicia disposed on said article.

20. The article of claim 17 including printed indicia disposed on said laminate cover.

* * * * *